US007524461B2

(12) United States Patent
Romaguera

(10) Patent No.: US 7,524,461 B2
(45) Date of Patent: Apr. 28, 2009

(54) MOTORIZED PIPETTE

(75) Inventor: Antonio Romaguera, Faulbach (DE)

(73) Assignee: Brand GmbH + Co. KG, Wertheim (DE)

( * ) Notice: Subject to any disclaimer, the term of this patent is extended or adjusted under 35 U.S.C. 154(b) by 802 days.

(21) Appl. No.: 10/846,840

(22) Filed: May 17, 2004

(65) Prior Publication Data

US 2005/0255006 A1 Nov. 17, 2005

(51) Int. Cl.
*B01L 3/02* (2006.01)

(52) U.S. Cl. ..... 422/100; 422/99; 73/864.01; 73/864.11

(58) Field of Classification Search ..... 422/100; 73/864.01, 864.11–864.16
See application file for complete search history.

(56) References Cited

U.S. PATENT DOCUMENTS 4,905,526 A * 3/1990 Magnussen et al. ..... 73/864.18
5,187,990 A 2/1993 Magnussen, Jr. et al.
6,090,348 A 7/2000 Steele et al.
6,254,832 B1 7/2001 Rainin et al.
6,540,964 B2 4/2003 Kohrmann et al.

OTHER PUBLICATIONS

Eppendorf Research Pro pp. 32-57.

* cited by examiner

*Primary Examiner*—Jill Warden
*Assistant Examiner*—Cedric Chan
(74) *Attorney, Agent, or Firm*—David S. Safran; Roberts Mlotkowski Safran & Cole, P.C.

(57) ABSTRACT

A motorized pipette is described for pipetting and titration of especially small amounts with an especially slow rate. An interruptable dispensing cycle allows extremely accurate titration and pipetting in which a take-up cycle is continued with an additional volume of a limited amount. Additionally, a certain minimum dispensing rate, which is preferably preset at the factory, for certain operating modes can be provided.

17 Claims, 4 Drawing Sheets

MOTORIZED PIPETTE

BACKGROUND OF THE INVENTION

1. Field of the Invention

The invention relates to a motorized pipette which has an electronic, programmable control. In particular, the invention relates to certain operating modes of such a pipette.

2. Description of Related Art

Motorized pipettes of the type under consideration are extensively used in processes for pipetting of relatively small amounts of liquid, and take various forms as shown in U.S. Pat. No. 5,187,990 A, U.S. Pat. No. 6,254,832 B1, U.S. Pat. No. 6,090,348 A2 and U.S. Pat. No. 6,540,964 B2.

The known motorized pipette is designed and suited for pipetting of relatively small amounts of liquid (for example 1 ml per dispensing cycle) as shown in U.S. Pat. No. 6,090,348 A. The motorized pipette can work in a standard operating mode in which a volume of sample liquid which is input beforehand is taken up and dispensed again, or it can also be operated as a repetition pipette with dispensing of a volume of liquid which has been taken up, in several stages.

There are motorized pipettes with interchangeable pipette tips which are slipped onto a tip receiving section (air cushion pipettes) or with complete syringes (plunger/cylinder arrangement) which are mounted on the tip receiving section (direct displacement pipettes). For the former see U.S. Pat. No. 5,187,990 A and U.S. Pat. No. 6,254,832 B2 as examples; while for the latter see for example U.S. Pat. No. 6,540,964 B2. The teaching is used especially in an air cushion pipette. Therefore, often only the pipette tip of an air cushion pipette is addressed, but such is not intended to preclude the fact that the corresponding features can also be implemented in a direct displacement pipette with a syringe.

The starting point for the teaching of the invention is a motorized pipette with an optionally multi-part housing which can be held in the hand, with a housing head, a grip part and pipette shaft with a tip holding section. In the housing, there are an electrical drive motor, especially a stepping motor, a positioning means which is driven by a drive motor for taking up and dispensing exactly defined, extremely small amounts of liquid, and an electronic control for the drive motor. In or on the housing there are at least one actuating element for actuating the control, at least one programming element for setting and/or programming different operating modes of the control, and an optical display means for display of operating modes, settings, etc. By means of the control, for example a certain take-up volume, a certain take-up rate, a certain dispensing volume, a certain dispensing rate and/or a certain expulsion overstroke for the sample liquid can be stipulated. A take-up cycle and/or a dispensing cycle for the sample liquid is started by actuating the actuating element and is automatically stopped by the control.

In a known motorized pipette for take-up and dispensing of defined amounts of liquid there is an actuating element for actuating the control. In addition, there are several programming elements (programming keys) and an optical display means in the form of a LCD display on which various unambiguous symbols, as well as letters and numbers, can be displayed. In this way operating modes, settings, etc. of the motorized pipette can be clearly communicated to the user.

In the known motorized pipette, the control is programmed such that a take-up cycle and/or a dispensing cycle for the sample liquid is started by actuating the actuating element, then proceeds automatically and is automatically stopped by the control itself at the end, i.e., specifically when a certain take-up volume has been reached, or when the complete, taken-up liquid volume has been expelled. In part, an expulsion overstroke is incorporated into the triggering of the positioning means by the control.

Other motorized pipettes allow an expulsion overstroke to be added after a waiting and collecting time of short duration, for example one second, as shown in U.S. Pat. No. 5,187,990 A which also shows a host of embodiments for programming the control of a motorized pipette of the type. This technology has been further developed in a later patent U.S. Pat. No. 6,254,832 B1; the entire disclosure of which is hereby incorporated by reference.

For special applications of motorized pipettes of the type under consideration in which a very small liquid volume, for example a liquid volume between 2 μl and 50 μl must be taken up and discharged in a concerted manner, it is recommended that a very low dispensing rate be set. This is relevant in the charging of electrophoresis gels because in such use turbulence must be prevented with the greatest possible consistency. The proper programming of the electronic control with a very low dispensing rate requires a high level of attentiveness of the user. Additionally, in applications involving very small liquid volumes, it would be desirable to know accurately the dispensed volume of sample liquid.

A known motorized pipette has provided an operating mode in which an especially low dispensing rate can be set and the dispensing cycle for the sample liquid can be interrupted. This is particularly advantageous for titration. This low dispensing rate is feasible for charging of electrophoresis gels.

The interruption of the dispensing cycle by actuating the actuating element can be accomplished by releasing the actuating element, which is held continuously pressed during the entire dispensing cycle, for interrupting the dispensing cycle. However, dispensing can proceed from a first actuation of the actuating element to start the dispensing cycle to a second actuation pointed in the same direction which interrupts the dispensing cycle.

With respect to the display in the display means, the display means works continuously; therefore the progressively dispensed volume of sample liquid is continuously displayed in the display means. A change of the display on the display means occurs when the dispensing cycle is interrupted. However, the display can also be such that during the current dispensing cycle for the sample liquid the display means does not display the dispensed volume, or any clearly recognizable display. Consequently, the volume of sample liquid which has been dispensed up to the interruption is clearly displayed in the display means only after the completed interruption.

This motorized pipette is already known for use in control engineering for charging of electrophoresis gels and for other applications with especially difficult boundary conditions of pipetting or titrating. Likewise, there are development possibilities for especially small volumes of liquid in a problematic environment.

SUMMARY OF THE INVENTION

The motorized pipette according to a first embodiment of the invention includes at least one selectable operating mode of the control for the take-up cycle of the sample liquid which can be advanced by actuating the actuating element beyond the nominal volume of the sample liquid which is stipulated by means of the control, and which is preferably displayed in the display means for taking up an additional volume. The additional volume is preferably between 5% and 30% of the nominal volume, especially roughly 10% to 15% of the nominal volume. Thus, it is possible, during the take-up cycle, to aspirate a residual amount of active liquid into the pipette tip, i.e., an amount which has possibly remained in the initial vessel. A valuable, often unknown sample liquid which is present only in an extremely small amount can thus be optimally used.

In an embodiment of the current invention, the additional volume can be taken up with a lower take-up rate than the nominal volume. The take-up rate for the nominal volume is often relative high. In order to avoid aspirating air, it is preferred that the residual volume in the initial vessel be carefully aspirated with a reduced take-up rate. The reduced take-up rate when compared to the smallest adjustable take-up rate can be reduced to a fraction of the smallest adjustable take-up rate. The take-up rate in this respect can be preset at the factory, but, alternatively, the take-up rate can also be selected by the user of the motorized pipette as well.

Another especially preferred embodiment for the motorized pipette of the invention is that the means of the control includes, in addition to at least one freely selectable dispensing rate, an especially low minimum dispensing rate which can be stipulated. It is especially advantageous when in an operating mode of the motorized pipette for electrophoresis, that the user can simply switch into the "electrophoresis" operating mode in which the minimum dispensing rate necessary for charging of electrophoresis gels is stipulated.

For the dispensing cycle with a minimum dispensing rate for the nominal volume a dispensing time of roughly 10 s to roughly 100 s is recommended, which can preferably be set, i.e., the minimum dispensing rate could then be changed by the user. However, it is also possible for certain applications, in which it is essentially a failsafe use, that the minimum dispensing speed is preset at the factory and preferably can no longer be changed by the user of the motorized pipette. Then, the change into the "electrophoresis" operating mode by itself is associated with the optimum, i.e., the smallest, dispensing rate in which operating errors can be avoided.

The use of the motorized pipette of the invention is of special interest for very small nominal volumes of the sample liquids which are to be taken up, between 2 μl and 50 μl, especially between 10 μl and 40 μl.

The invention is detailed below using drawings which show only one embodiment.

DETAILED DESCRIPTION OF THE INVENTION

Figure 1:
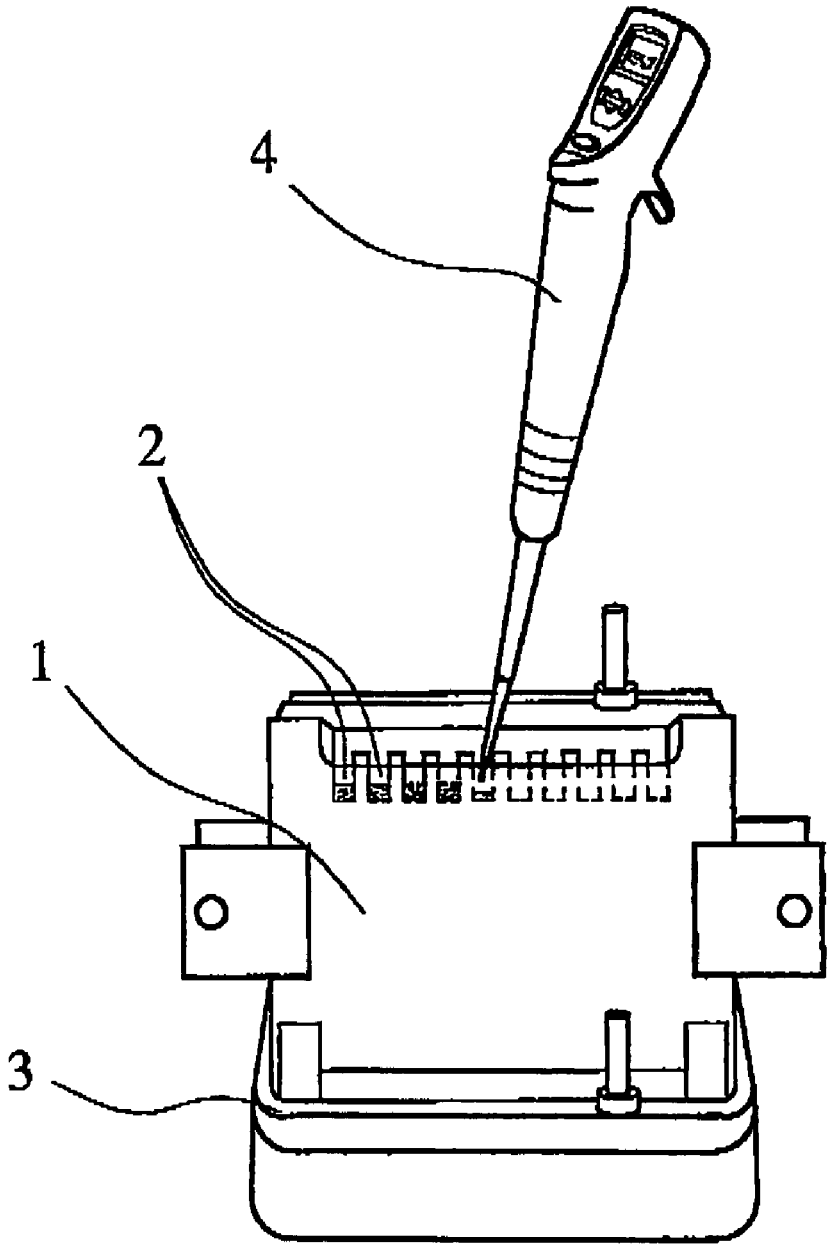
FIG. 1 shows a laboratory arrangement for gel electrophoresis as a preferred application use of the motorized pipette of the invention.

The experimental arrangement shown in FIG. 1 for gel electrophoresis illustrates only one special example of a motorized pipette of the invention which is to be understood as not limiting of the invention, but rather only one embodiment thereof.

A gel apparatus 1 is shown in which the gel which is used for gel electrophoresis is located. The basis of this procedure is the finding that macromolecules such as DNA, RNA and proteins are charge carriers and therefore can migrate in an electrical field. The migration in the electrical field is guided by the latter being made on a gel. By polymerization the gel leads to a net-like composite with a pore size which can be influenced by the composition of the gel. An electrolyte is used to form the electrical field in which then the macromolecules can migrate. The migration at the corresponding setting of the system is dependent on the size of the molecules and thus on their mass. In this way, separation of the different molecules can be induced and can be detected in an experimental arrangement.

On the top of the gel apparatus 1 there are wells 2 into which by means of the illustrated motorized pipette 4 the desired extremely small amounts of the sample liquid or liquids must be pipetted. In doing so, extreme care must be exercised so that no sample liquid is carried from one well into another. Underneath there is an electrolyte bath 3.

The sample liquid is generally a liquid with a water-like or simply slightly higher density. Its density can be increased when a thickener is added, for example a small portion of glycerin. In this way, influencing the consistency of the sample liquid carrying from well to well is prevented.

For the motorized pipette itself it is possible to prevent sample liquid from being carried from well to well by the sample liquid's being dispensed especially slowly in an operating mode which is especially well suited to electrophoresis. In this way, turbulence upon emergence of the sample liquid from the pipette tip into the well is prevented.

The subject matter of the invention is a motorized pipette 4 which is designed and suited not only for use in the charging of electrophoresis gels. Rather it can be used in general, but has some particular features which can be especially employed in the above explained process.

Figure 2:
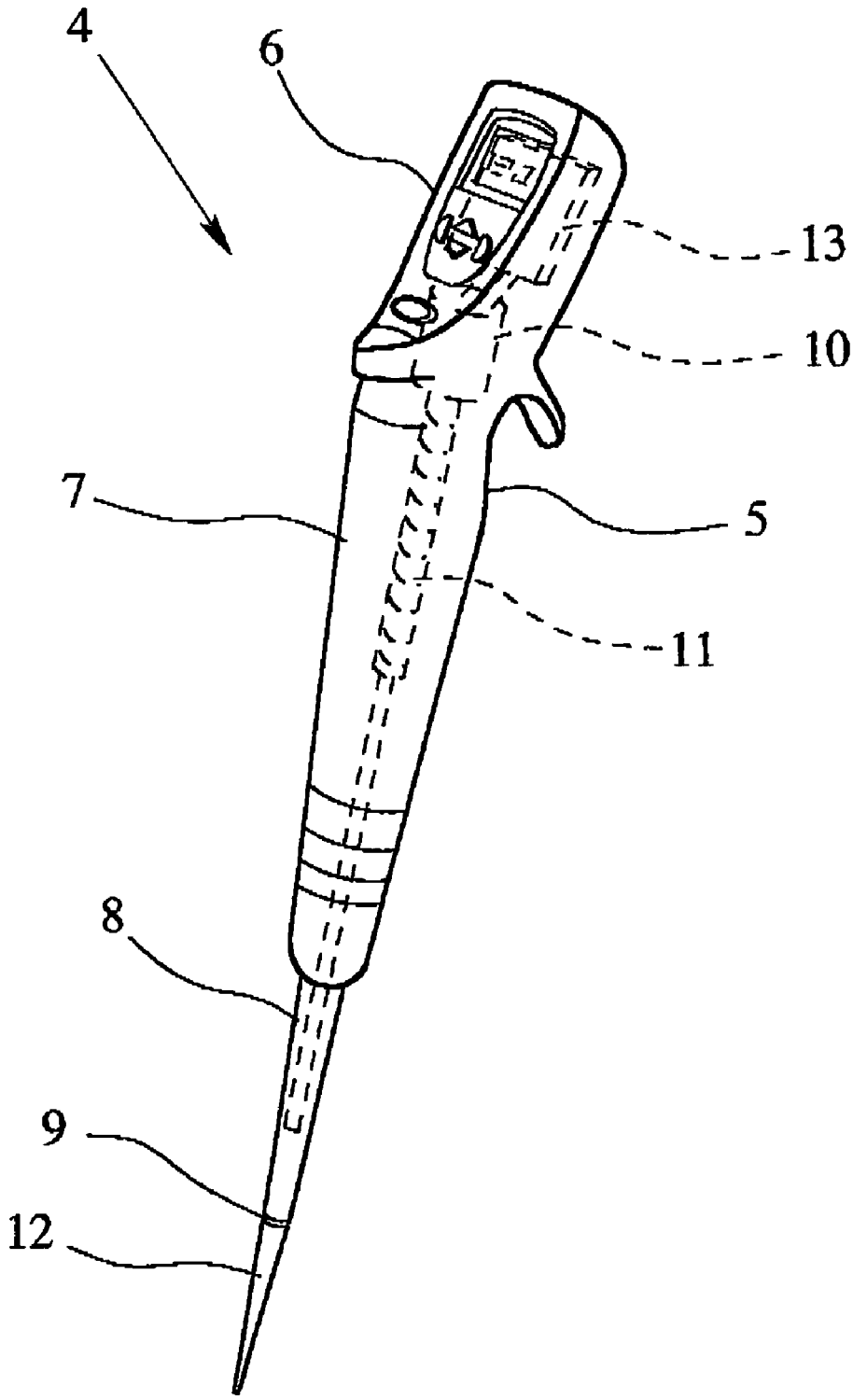
FIG. 2 shows an enlargement of the motorized pipette already indicated in FIG. 1, with the components of the motorized pipette located in the housing indicated in a broken line representation.

The motorized pipette 4 shown in FIG. 2 enlarged has a housing 5 which can be held in the hand. This housing 5 is made as a multipart, shell-like housing. In the prior art there are also housings which are composed of several structural units, see U.S. Pat. No. 6,254,832 B1. All this can also be implemented within the framework of the motorized pipette of the invention.

The housing has a housing head 6, a grip part 7, a pipette shaft 8 and then a tip receiving section 9. In the housing 5 there is an electrical drive motor 10 which is likewise indicated in FIG. 2 like the positioning means 11 which is driven by the drive motor 10. The drive motor 10 is preferably a stepping motor.

In the motorized pipette 4 which is an air cushion pipette, the positioning means 11 is normally a plunger positioning means with which the plunger can be gradually advanced for purposes of individual metering of certain metered amounts. In the air cushion pipette, as is described for example in U.S. Pat. No. 6,090,348 A and U.S. Pat. No. 5,187,990 A, between the plunger in the housing 5 and the liquid level in the mounted pipette tip 12 there is an air cushion which prevents contamination of the plunger. The positioning means 11 is used to take up and dispense precisely defined, extremely small amounts of liquid into and out of the pipette tip 12 which has been slipped onto the tip receiving section 9 for this purpose. The tip 12 is a disposable product which generally composed of plastic and after use is pulled off the tip receiving section 9 and discarded.

In a motorized pipette which is made as a direct displacement body, see for example U.S. Pat. No. 6,540,964 B, an inherently closed tip with a plunger and cylinder is used. The plunger is then coupled to the positioning means 11 in the housing 5. However, the embodiments of the invention can also be implemented with a direct displacement body. In the housing 5 there is the electronic control 13 for the drive motor 10.

Figure 3:
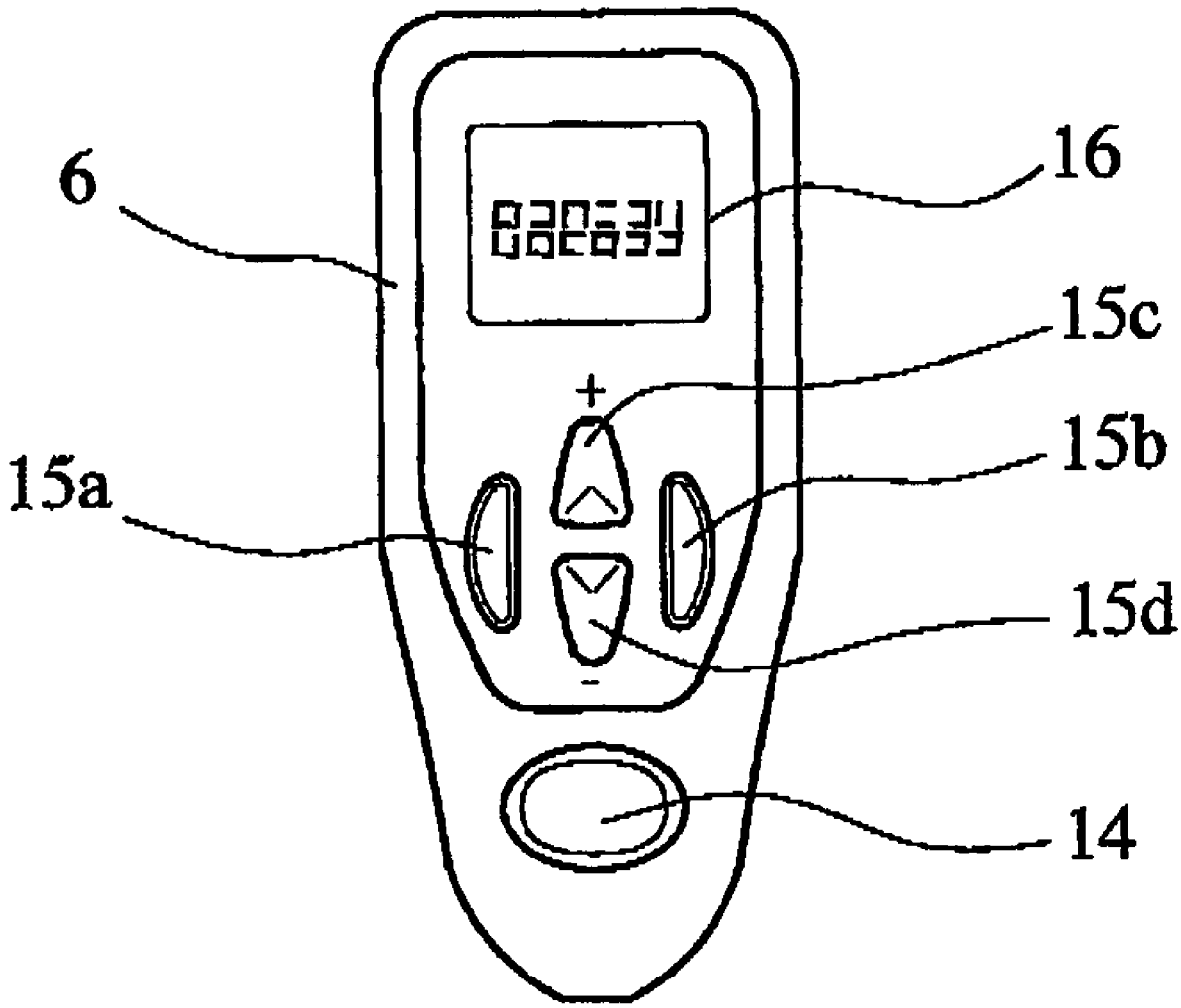
FIG. 3 shows an enlargement of the housing head of the motorized pipette from FIG. 2

FIG. 2, in conjunction with FIG. 3, clearly shows that on the housing 5 (in another design also in the housing) there are at least one actuating element 14 for actuation of the control 13, at least one programming element 15 for setting and/or programming of different operating modes of the control 13 and an optical display means 16, here shown as an LCD display, for display of the operating modes, settings, etc. The display means 16 can also be made differently than as an LCD display, for example as an LED display or combined in some other way, for example with checking lights, etc.

By means of the control 13 a certain take-up volume, a certain take-up rate, a certain dispensing volume, a certain dispensing rate, and a certain expulsion overstroke (blow-out) for the sample liquid are be stipulated. One take-up cycle and/or one dispensing cycle for the sample liquid is started by actuating the actuating element 14 and in any case is ultimately stopped automatically by the control 13.

FIG. 3 shows in an enlargement the housing head 6 with the LCD display there as the display means 16, a single actuating element 14 for actuating the control 13 and a total of four programming elements 15*a,b,c,d*, i.e., selection key 15*a*, turn-on and input key 15*b*, up key 15*c*, down key 15*d*. Other configurations are implemented here in the prior art. The exact configuration of the housing head 6 is not of significance to the invention either.

Figure 4:
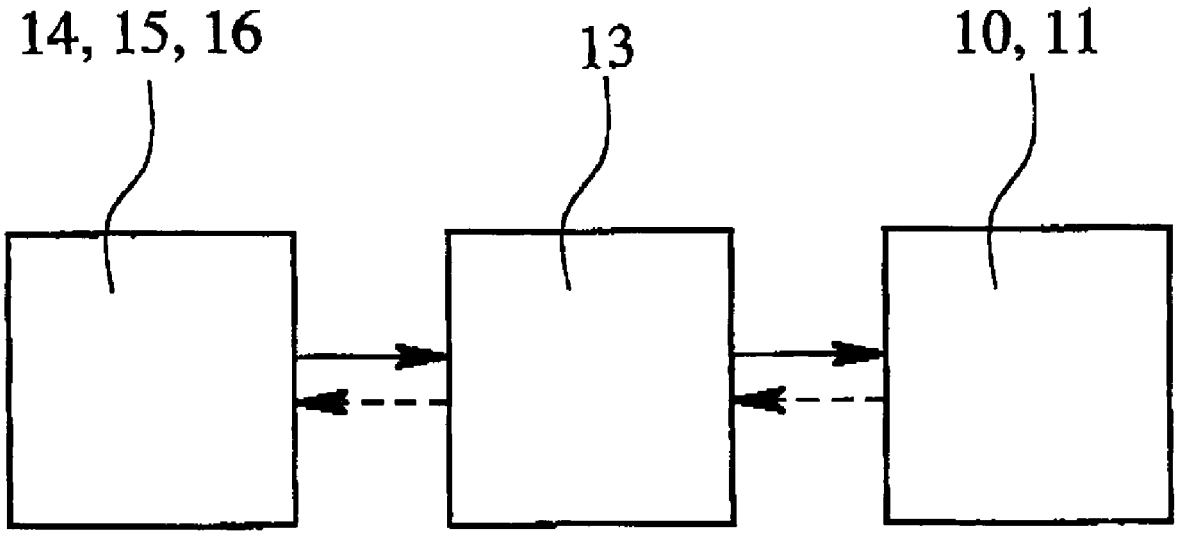
FIG. 4 shows in a block diagram a representation which indicates the control engineering relationships of the motorized pipette of this invention.

FIG. 4 shows the control engineering relationships between the control 13, the positioning means 11 and the actuating element 14/programming element 15.

In an embodiment of the invention, at least one selectable operating mode of the control 13 for the dispensing cycle for the sample liquid can be interrupted at any time by actuating the actuating element 14. Further, when the dispensing cycle is interrupted the volume of sample liquid which has been dispensed until the interruption is displayed in the display means 16. Thus the dispensing cycle can be briefly stopped and it is known exactly how much volume of sample liquid has been dispensed so far. The wells 2 are not all the same size so that a smaller volume than originally intended can be taken up. In titration, this display is advantageous anyway, as is already known in the prior art.

It is preferable that after a completion of the interruption, re-actuation of the actuating element 14 will result in the dispensing cycle being continued to the end. It has already been explained above that the term "actuation" for the actuating element 14 can also mean that continuing actuation is interrupted, for example when a key is held down and then released. However, "actuation" can also mean that a first actuation and afterwards a second actuation in the same direction takes place. The selection of a form of actuation of the actuating elements 14 depends on ergonomic and programming considerations desired.

In a preferred embodiment, the invention includes in the ability during at least one selectable operating mode of the control 13 that the take-up cycle for the sample liquid can be interrupted at any time by actuating the actuating element 14. When the take-up cycle is interrupted, the volume of sample liquid which has been taken up until interruption is displayed in the display means 16. It is also recommended that continuation of the take-up cycle proceed by re-actuation of the actuating element 14. Similar considerations with regard to the dispensing cycle are also within the scope of the invention.

In an embodiment of the invention, in at least one selectable operating mode of the control 13 the take-up cycle for the sample liquid can be continued by actuating the actuating element 14 to take up the sample liquid beyond the nominal volume which is controlled by the control and which the additional volume is preferably displayed on the display means 16. The additional volumes are preferably between 5% and roughly 30% of the nominal volume. It has been shown that limitation of the additional volume to roughly 10% to 15% of the nominal volume corresponds to the requirement profile which often prevails in practice. Here, such an additional volume can be set fort on the display means 16 as an additional symbol displayed when the mode of taking-up an additional volume.

The motorized pipette 4 of the invention preferably has exactly one actuating element 14 which executes each form of actuation of the control 13. This is ergonomically especially feasible and allows simple manipulation.

The special situation for certain pipetting tasks has already been extensively explained above, especially for charging of electrophoresis gels. In this regard, it is particularly preferred that the control 13 provides for the stipulation, in addition to at least one freely selectable dispensing rate, an especially low minimum dispensing rate. In this embodiment, it is preferred that for the dispensing cycle of the nominal volume at the minimum dispensing rate a time interval of approximately 10 s to approximately 100 s be provided to set the minimum dispensing rate roughly to this time frame.

A minimum dispensing rate which is preset at the factory and which is assigned to the special operating mode is more preferred than a minimum dispensing rate which can be changed by the user of the motorized pipette 4, even if the minimum dispensing rate is also stipulated as fixed.

Thus improper operation by the user is for the most part reliably eliminated. Further, on the display means 16 there can be a special symbol or plain text indication for the electrophoreses operating mode, for example the plain text indication "GEL".

It has already been pointed out above that the special application of the motorized pipette of the invention is for pipetting of nominal volumes between 2 μl and 50 μl, especially between 10 μl and 40 μl, without other ranges of volumes being precluded for example. There is a special application of the motorized pipette 4 of the invention in which dispensing of sample liquids with water-like or moderately higher density can easily occur without turbulence.

Finally, an especially preferred embodiment of the invention includes a motorized pipette which provides an interruptable dispensing cycle for the continuous take-up cycle in which an additional volume and a certain minimum dispensing rate, preset at the factory, are available for certain operating modes, particularly the gel mode.

The invention claimed is:

1. Motorized pipette which can be held by hand comprising:

a housing head;

a grip part; and a pipette shaft with a tip receiving section for receiving a detachable pipette tip or for a complete syringe, wherein the housing head includes:

an electrical drive motor;

a positioning means which is driven by the drive motor for taking up and dispensing exactly defined, extremely small amounts of liquid;

an electronic control for the drive motor, at least one actuating element for actuating the electronic control;

at least one programming element for at least one of selling and programming different operating modes of the electronic control, said modes comprising at least a take-up cycle and a dispensing cycle; and an optical display means for display of operating modes and settings, wherein the electronic control is adapted for specifying at least a certain nominal take-up volume, and a certain take-up rate for a sample liquid, and wherein actuation of the actuating element is operative for starting either an automatic take-up cycle or an automatic dispensing cycle of the sample liquid and the electronic control automatically stops the take-up cycle or dispensing cycle, and wherein, in at least one selectable operating mode of the electronic control, the electronic control is operative to continue the take-up cycle for the sample liquid by actuating the actuating element, to automatically take up an additional volume, beyond said nominal take-up volume of the sample liquid which is stipulated by means of the electronic control, wherein the additional volume is between 5% and 30% of the nominal take-up volume, wherein the electronic control is operative for producing a take-up rate for the additional volume that is lower than a smallest adjustable take-up rate of the nominal take-up volume, and wherein the additional volume is displayed on the display means.

2. Motorized pipette as claimed in claim 1, wherein a minimum dispensing rate can be stipulated which is less than the dispensing rate for other operating modes, wherein a dispensing cycle for the nominal volume at the minimum dispensing rate lasts approximately 10 s to 100 s, wherein the nominal volume of the sample liquid volumes to be taken up is between 2 μl and 50 μl, and wherein the sample liquid has a density equal to or slightly higher than water.

3. Motorized pipette as claimed in claim 2, wherein the minimum dispensing rate is a factory preset rate.

4. Motorized pipette as claimed in claim 3, wherein the minimum dispensing rate is fixed and is not changable by the user of the motorized pipette.

5. Motorized pipette as claimed in claim 1, wherein the housing is constructed as a multi-part housing.

6. Motorized pipette which can be held by hand comprising:

a housing head;

a grip part;

a pipette shaft with a tip receiving section for receiving a detachable pipette tip or for a complete syringe;

an electrical drive motor;

a positioning means which is driven by a drive motor for taking up and dispensing exactly defined, extremely small amounts of liquid;

an electronic control for the drive motor;

at least one actuating element for actuating the electronic control;

at least one programming element for at least one of setting and programming different operating modes of the electronic control, said modes comprising at least a take-up cycle and a dispensing cycle; and an optical display means for display of the operating modes and settings, wherein the electronic control is adapted for setting at least a certain nominal dispensing volume, each of a plurality of dispensing rates and a certain expulsion overstroke for a sample liquid, wherein the electronic control is operative for producing the dispensing cycle for the sample liquid in response to actuating of the actuating element and wherein the dispensing cycle is automatically stopped by the electronic control, wherein, in at least one selectable automatic operating mode of the electronic control, one of the dispensing rates is triggered that automatically provides a minimum dispensing rate which is less than the dispensing rate for the other dispensing cycle operating modes, wherein the dispensing cycle lasts approximately 10 s to 100 s for dispensing said nominal dispensing volume at the minimum dispensing rate, wherein the electronic control is operable for interrupting the automatic operating mode providing said minimum dispensing rate at any time in response to actuation of the actuating element, said display means being adapted to display, when the dispensing cycle is interrupted, the volume of sample liquid which has been dispensed up to the interruption, wherein re-actuation of the actuating element is operable for causing the electronic control to terminate the interruption and to continue the dispensing cycle; and wherein the electronic control is operative for producing a take-up rate for the additional volume that is lower than a smallest adjustable take-up rate of the nominal take-up volume, and wherein the additional volume is displayed on the display means.

7. Motorized pipette as claimed in claim 6, wherein the minimum dispensing rate is a factory preset rate.

8. Motorized pipette as claimed in claim 7, wherein the minimum dispensing rate is fixed so as not to be user changable.

9. Motorized pipette as claimed in claim 8, wherein a nominal volume of the sample liquid volumes to be taken up is between 2 μl and 50 μl.

10. Motorized pipette as claimed in claim 6, wherein the minimum dispensing rate for the at least one operating mode is fixed, but is changeable by the user of the motorized pipette.

11. Motorized pipette as claimed in claim 10, wherein a nominal volume of the sample liquid volumes to be taken up is between 2 μl and 50 μl.

12. Motorized pipette as claimed in claim 6, wherein, in at least one selectable operating mode of the electronic control, the take-up cycle for the sample liquid can be continued, via actuation of the actuating element, for automatically taking up an additional volumes, beyond a nominal volume of the sample liquid stipulated by the electronic control, and wherein the additional volume is displayed on the display means.

13. Motorized pipette as claimed in claim 12, wherein the additional volume is between 5% and 30% of the nominal volume.

14. Motorized pipette as claimed in claim 6, wherein the sample liquid has a density equal to or slightly higher than water.

15. Motorized pipette as claimed in claim 6, wherein a nominal volume of the sample liquid volumes to be taken up is between 2 μl and 50 μl.

16. Motorized pipette which can be held by hand comprising:

a housing head;

a grip part; and a pipette shaft with a tip receiving section for receiving a detachable pipette tip or for a complete syringe, wherein the housing head includes:

an electrical drive motor;

a positioning means which is driven by the drive motor for taking up and dispensing exactly defined, extremely small amounts of liquid;

an electronic control for the drive motor, at least one actuating element for actuating the electronic control;

at least one programming element for at least one of setting and programming different operating modes of the electronic control, said modes comprising at least a take-up cycle and a dispensing cycle; and an optical display means for display of operating modes and settings, wherein the electronic control is adapted for specifying at least a certain nominal take-up volume, and a certain take-up rate for a sample liquid, and wherein actuation of the actuating element is operative for starting either an automatic take-up cycle or an automatic dispensing cycle of the sample liquid and the electronic control automatically stops the take-up cycle or dispensing cycle, and wherein, in at least one selectable operating mode of the electronic control, the electronic control is operative to continue the take-up cycle for the sample liquid by actuating the actuating element, to automatically take up an additional volume, beyond said nominal take-up volume of the sample liquid which is stipulated by means of the electronic control, wherein the additional volume is between 5% and 30% of the nominal take-up volume, wherein the electronic control is operative for producing a take-up rate for the additional volume that is lower than a smallest adjustable take-up rate of the nominal take-up volume, and wherein the additional volume is displayed on the display means; and wherein the additional volume is approximately 10% to 15% of the nominal take-up volume.

17. Motorized pipette which can be held by hand comprising:

a housing head;

a grip part;

a pipette shaft with a tip receiving section for receiving a detachable pipette tip or for a complete syringe;

an electrical drive motor;

a positioning means which is driven by a drive motor for taking up and dispensing exactly defined, extremely small amounts of liquid;

an electronic control for the drive motor;

at least one actuating element for actuating the electronic control;

at least one programming element for at least one of setting and programming different operating modes of the electronic control, said modes comprising at least a take-up cycle and a dispensing cycle; and an optical display means for display of the operating modes and settings, wherein the electronic control is adapted for setting at least a certain nominal dispensing volume, each of a plurality of dispensing rates and a certain expulsion overstroke for a sample liquid, wherein the electronic control is operative for producing the dispensing cycle for the sample liquid in response to actuating of the actuating element and wherein the dispensing cycle is automatically stopped by the electronic control, wherein, in at least one selectable automatic operating mode of the electronic control, one of the dispensing rates is triggered that automatically provides a minimum dispensing rate which is less than the dispensing rate for the other dispensing cycle operating modes, wherein the dispensing cycle lasts approximately 10 s to 100 s for dispensing said nominal dispensing volume at the minimum dispensing rate, wherein the electronic control is operable for interrupting the automatic operating mode providing said minimum dispensing rate at any time in response to actuation of the actuating element, said display means being adapted to display, when the dispensing cycle is interrupted, the volume of sample liquid which has been dispensed up to the interruption, wherein re-actuation of the actuating element is operable for causing the electronic control to terminate the interruption and to continue the dispensing cycle; and wherein, in at least one selectable operating mode of the electronic control, the take-up cycle for the sample liquid can be continued, via actuation of the actuating element, for automatically taking up an additional volume, beyond a nominal volume of the sample liquid stipulated by the electronic control, wherein the electronic control is operative for producing a take-up rate for the additional volume that is lower than a smallest adjustable take-up rate of the nominal take-up volume, and wherein the additional volume is displayed on the display means; and wherein the additional volume is approximately 10% to 15% of the nominal take-up volume.

* * * * *